US006974248B2

(12) United States Patent
Damasko

(10) Patent No.: US 6,974,248 B2
(45) Date of Patent: Dec. 13, 2005

(54) CROWN FOR WATCHES AND A TOOL FOR ATTACHING A SCREW-IN TUBE FOR THE CROWN ARRANGEMENT ON A WATCH CASE

(75) Inventor: Konrad Damasko, Barbing (DE)

(73) Assignee: Petra Damasko, Regensburg (DE)

( * ) Notice: Subject to any disclaimer, the term of this patent is extended or adjusted under 35 U.S.C. 154(b) by 72 days.

(21) Appl. No.: 10/611,426

(22) Filed: Jul. 2, 2003

(65) Prior Publication Data

US 2004/0090873 A1 May 13, 2004

(30) Foreign Application Priority Data

Jul. 3, 2002 (DE) ..... 202 10 345 U

(51) Int. Cl.[7] ..... G04B 29/00; G04B 37/00
(52) U.S. Cl. ..... 368/308; 368/319
(58) Field of Search ..... 368/319–321, 368/206, 288–290, 306–308; 81/6, 122, 176.1, 81/176.15

(56) References Cited

U.S. PATENT DOCUMENTS

| | | | | |
|---|---|---|---|---|
| 4,062,179 | A * | 12/1977 | Koike | 368/321 |
| 4,092,879 | A * | 6/1978 | Hernandez | 81/6 |
| 4,292,682 | A * | 9/1981 | Wenger | 368/289 |
| 5,383,166 | A * | 1/1995 | Gallay | 368/288 |
| 6,137,750 | A * | 10/2000 | Rieben | 368/290 |
| 6,200,020 | B1 * | 3/2001 | Rieben | 368/290 |
| 6,447,159 | B1 * | 9/2002 | Damasko | 368/308 |

* cited by examiner

*Primary Examiner*—Vit W. Mska
(74) *Attorney, Agent, or Firm*—Hoffman, Wasson & Gitler, P.C.

(57) ABSTRACT

A crown for watches, especially wristwatches or pocket watches, the crown body which is provided on a winding stem is made up of two parts and includes of a first part which forms the grip surface of the crown and a second part. The crown body furthermore has a crown body thread and can be screwed to a penetration which is provided on the watch case for the winding stem.

12 Claims, 5 Drawing Sheets

FIG. 2
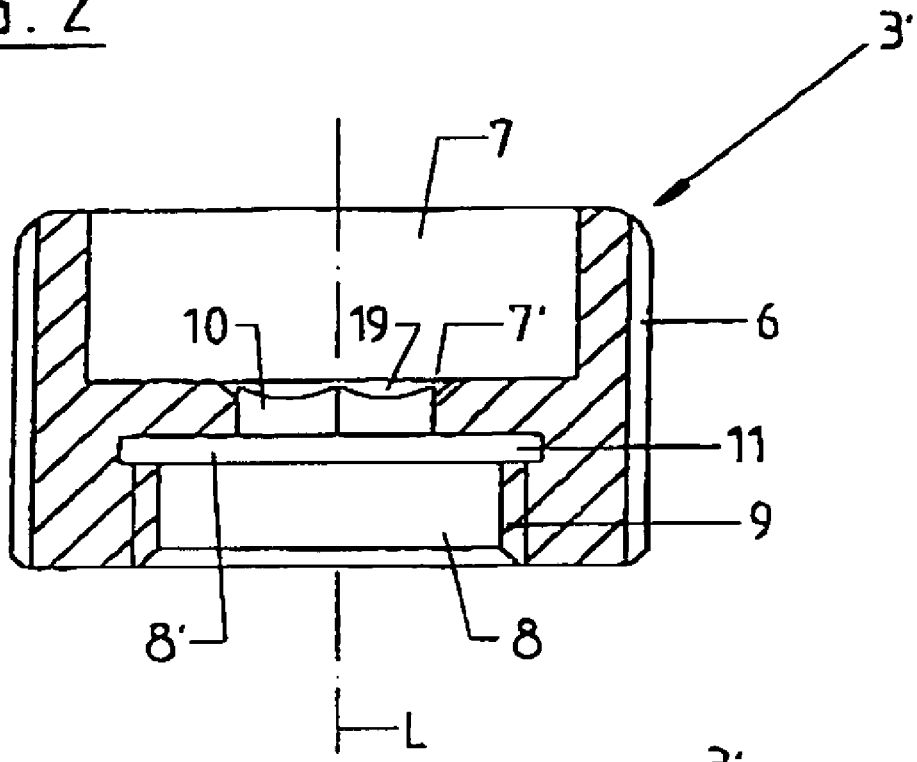
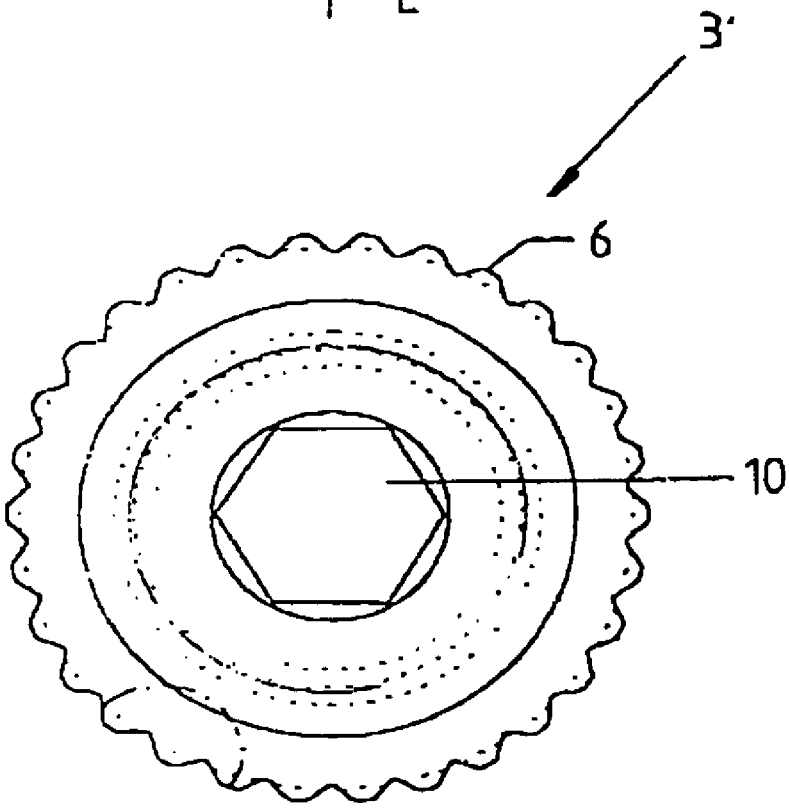
FIG. 3

CROWN FOR WATCHES AND A TOOL FOR ATTACHING A SCREW-IN TUBE FOR THE CROWN ARRANGEMENT ON A WATCH CASE

BACKGROUND OF THE INVENTION

The invention relates to a crown and a crown arrangement including a crown and a tube, especially a screw-in tube and to a tool for mounting the screw-in tube in the watch case.

Crowns for watches, especially for wristwatches and pocket watches, are known. In particular, so-called screwable crowns are also known for wrist watches, i.e. crowns which can be screwed when not in use to a penetration (tube) provided in the watch housing for the winding stem in order to attain a tight seal.

These screwable crowns are made such that their crown body can be axially moved on the winding stem by a given stroke such that the drive connection between the crown and the winding stem is cancelled by this axial displacement and thus the crown body can be screwed without turning the winding stem to the tube and the winding stem penetration.

In the known, screwable crown, the crown body is made in two parts, i.e. it consists of an outer hood-like part which forms the gripping surface of the crown and a sleeve-shaped insert which is inserted into an opening of the first part from the side of the crown body facing the watch case or the tube. This sleeve-shaped insert on the one hand forms a guide surface on which the crown body is guided to be able to move axially on the section of the winding stem which is enlarged in diameter, and on the other hand also forms a coupling section with the shape of a hexagon socket which interacts with the coupling section of the winding stem formed by a hexagon insert bit. The latter coupling section is provided on the free end of the winding stem which extends into the crown body.

The disadvantage in this known construction is that at a given outside diameter of the crown body, the effective diameter of the two coupling sections is greatly reduced and thus force is transferred on a small diameter so that in this known crown there is a great danger of wearing of the interacting coupling sections and thus operation of the crown is not permanently ensured.

The object of the invention is to devise a crown which avoids these disadvantages with the possibility of simplified production.

SUMMARY OF THE INVENTION

To achieve this object a crown is made with a winding stem. The crown body is made of two parts, a first part which forms the grip surface of the crown and a second part which can be screwed to the crown body thread with a penetration which is provided on the watch case of the winding stem. The second part ha a first coupling piece which is formed on the crown body by the opening with an inside cross section which is not circular, and a second coupling section on the winding stem with an outside cross-section which is matched to the inside cross-section of the first coupling section. The coupling sections disengage by axial displacement of the crown body which is axially guided on the guide section of the winding stem. The first part of the crown body can be screwed to the tube and has a first coupling section. The second part of the crown body is used as an insert into the recess of the first part from the side facing away from the tube. The crown arrangement is made as claimed in claim 11. Also provided is a tool for maintaining a screw in tube on a watch with which the penetration or tube for the winding stem can be mounted in an especially simple manner.

BRIEF DESCRIPTION OF THE DRAWINGS

The invention is detailed below using the figures on embodiments.

FIG. 2 and FIG. 3 show the crown body in a section and in a top view;

DETAILED DESCRIPTION OF THE INVENTION

Figure 1:
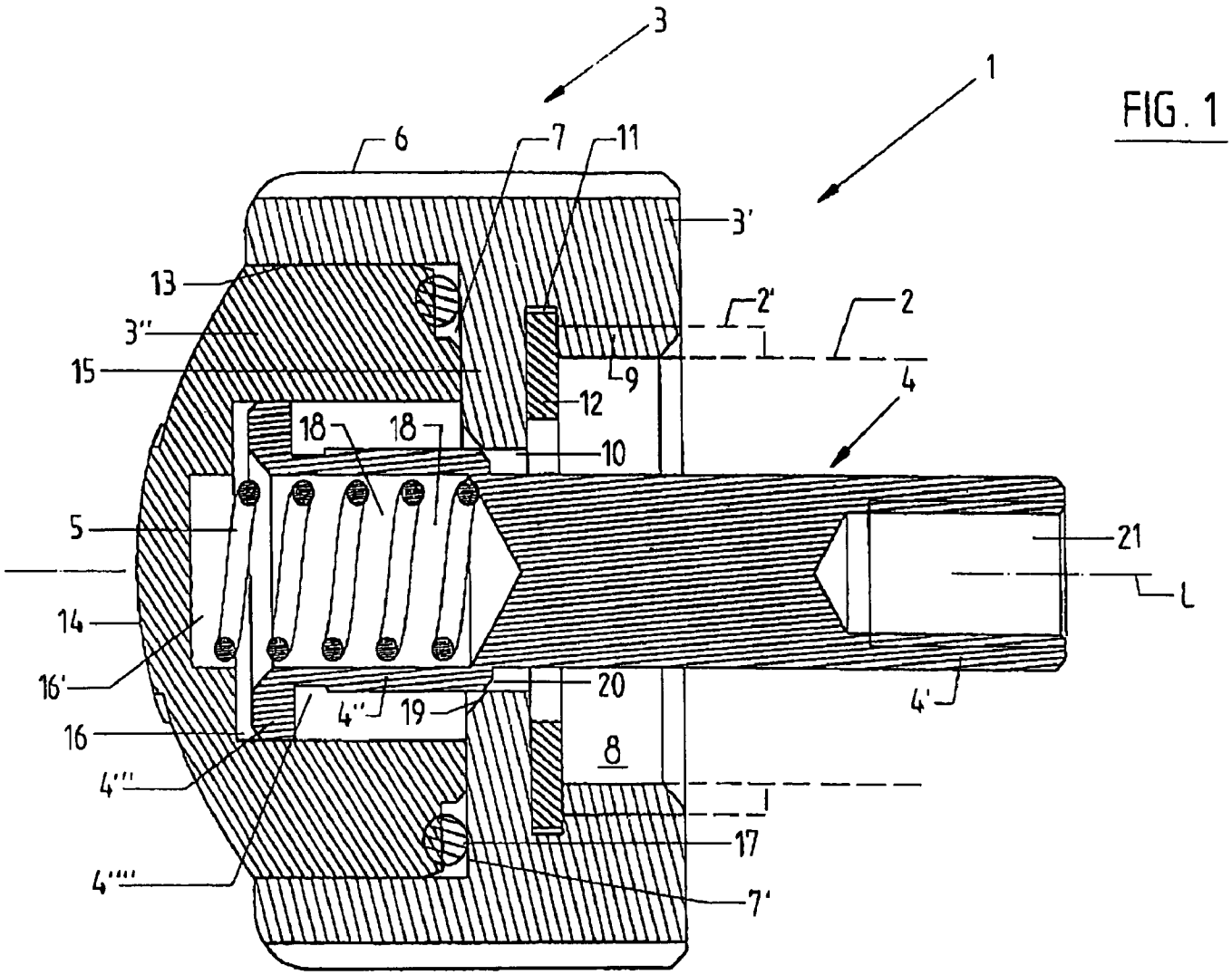
FIG. 1 shows in a section a crown as claimed in the invention for use in a wristwatch or pocket watch.
Figure 4:
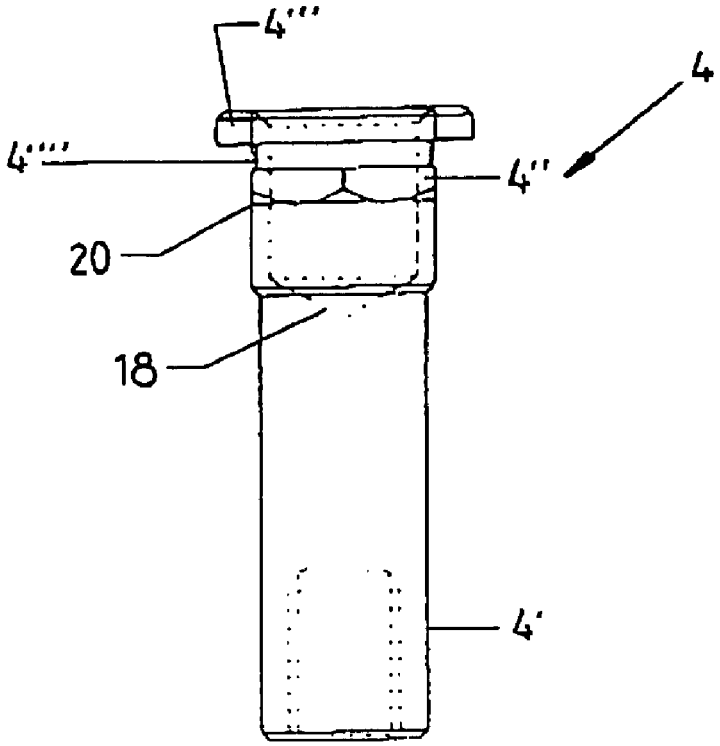
FIG. 4 and FIG. 5 show the crown winding stem in a side view and in a top view.
Figure 5:
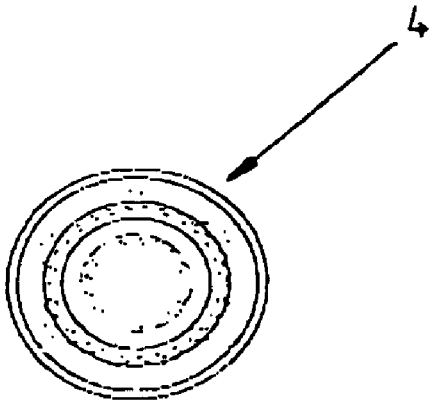

In FIGS. 1–5, a crown 1 can be fixed or sealed by screwing onto the crown, or winding stem penetration (also tube) which is shown in FIG. 1 with the broken lines 2.

The crown 1 is made up of a two-part crown body 3 and a winding stem 4 which in the conventional manner interacts with the movement of the watch. Furthermore, there is a compression spring 5 which acts between the winding stem 4 and the crown body 3 and pretensions it in the lengthwise direction L of the winding stem 4 in the working state in which the crown body 3 is dynamically engaged with the winding stem 4. FIG. 1 shows the crown 1 in the state in which it is screwed to the tube 2 on the watch case 26 (FIG. 6) and in which the crown body 3 is disengaged from the winding stem 4 against the action of the compression spring 5. L in FIG. 1 labels the lengthwise axis of the crown which is also the axis of the crown body 3 and of the winding stem 4.

As mentioned, the crown body 3 is made in two parts including the crown body part 3' and the crown body part 3". The part 3' which is detailed again in FIGS. 2 and 3 is made essentially sleeve-like with knurling 6 on a circular-cylindrical peripheral or grip surface and has a first, circular-cylindrical recess 7 open towards one face of the part 3' with a bottom surface 7' and a likewise circular-cylindrical recess 8 which is open towards the other face with a bottom surface 8'. The recess 8 has a diameter which is smaller than the diameter of the recess 7 and is provided with an inside thread 9 with which the crown body 3 can be screwed to the outside thread of the tube 2.

Between the two recesses 7 and 8 and their bottom surfaces 7' and 8' in the part 3' there is an opening 10 which is arranged to be coaxial with these recesses and the lengthwise axis L and which is made with a cross section which differs from a circular shape, in this embodiment with a hexagonal cross section, the cross sectional dimensions of the opening 10 being smaller than the cross sectional dimension or the diameter of the recess 8. On the transition from the recess 8 to the opening 10 the recess 8 is provided with an undercut 11 which houses, with the crown 3 mounted, a ring seal 12 which is supported against the bottom surface and lies tightly against the flange 2 for a crown 1 which has been screwed on the watch case.

The insert or part 3" is made essentially hood-like, with a circular-cylindrical peripheral surface 13 and a convexly curved end face 14. Furthermore, in the part 3" a circularly cylindrical recess 16 which is open towards the end face 15 which is opposite the end face 14 is made with an axis which is coaxial to the lengthwise axis L when the crown 3 is mounted. The recess 16 forms on its closed end adjacent to the end face 14 a seat 16' for one end of the compression spring 5. As FIG. 1 shows, the recess 16 has a diameter which is greater than the largest cross sectional dimension of the opening 10.

The part 3" with the crown 1 mounted is inserted into the recess 7 of the part 3' with the open side of the recess 16 forward and is attached there in a suitable manner, for example by an interference fit. Furthermore, the transition between the two parts 3' and 3" is sealed by an additional ring seal 17.

The winding stem 4 on its section 4' which is connected to the movement and which projects out of the crown body 3 has a circularly cylindrical cross section. With this section 4' the winding stem extends through the recess 8 and in the state of the crown 1 shown in FIG. 1, in which (state) there is no drive connection between the crown body 3 and the winding stem 4, also through the opening 10.

Following the section 4' the winding stem 4 is provided with a section 4" which is enlarged in cross section, with an outside cross section which is matched to the cross sectional shape of the opening 10, i.e. in the embodiment shown likewise forms a hexagonal cross section so that with axial displacement of the crown body 3 relative to the winding stem 4 the section 4" engages the opening 10 and thus a drive-connection between the crown body 3 and the winding stem 4 is established.

The section 4" with an outside diameter which is likewise smaller than the diameter of the recess 16 is followed by a flange-like, annular ring-shaped section 4'" with an outside diameter which is equal to the diameter of the recess 16 and which forms the end of the winding stem 4 facing the end face 14.

On the section 4'" the crown body 3 on the winding stem 4 is also reliably guided when the section 4" is no longer engaged to the opening 10, as is shown in FIG. 1. Furthermore, the section 4'" forms a stop which limits the motion of the crown body 3 by the compression spring 5 by its coming to rest against the bottom area 7' of the recess 7 surrounding the opening 10. Between the sections 4" and 4'" there is a clearance cut 4"" with a circularly cylindrical cross section.

The winding stem 4 furthermore has a hole 18 which is coaxial with the lengthwise axis L and is open towards the end face of this winding stem which has the section 4'". The hole 18 is used to partially hold the compression spring 5 and forms on its closed end a second support surface for this spring.

As the figures also show, the opening 10 and the section 4" on the transition to the section 4' are bevelled each at 19 and 20 conically or in the shape of a truncated cone so that problem-free engagement of the section 4" or of the hexagon formed by this section with the opening 10 or with the hexagon socket which is formed by this opening is ensured.

On the end which is away from the section 4'" the winding stem 4 or the section 4' is provided with another hole 21 which runs coaxially with the axis L and via which the winding stem 4 can be connected to a shaft which is not shown or an actuating square which interacts with the movement.

At least the winding stem 4 and the part 3' of the crown body 3 are made of especially hard steel, for example of heat treatable high quality steel or steel of class 1.4435 with additional carbon diffusion coating.

The crown 1 has among others the following advantages:

It consists of a few parts which are relatively simple in their shape so that simplified production is possible.

At a given overall diameter of the crown body 3 it is possible to provide the drive connection between the crown body 3 and the winding stem 4 on a relatively great diameter, with which, considering the material used, wearing of the hexagonal surfaces which interact with one another on the section 4" or on the opening 10 is also avoided. The recess 16 and the section 4'" which is guided in this recess achieve perfect guidance of the crown body 3 on the winding stem 4 even during the critical state in which the inside thread 9 is not yet engaged with the outside thread of the tube body 2 and the drive connection between the winding stem 4 and the crown body 3 is still interrupted.

As also shown in FIG. 1, the insert or part 3" does not limit the diameter of the opening 10 or of the section 4" The crown 1 as claimed in the invention is mounted such that first the winding stem 4 with the free end of its section 4' is inserted through the recess 7 into the opening 10. Then the spring 5 is mounted in the opening 18 and then the insert or the part 3" is inserted into the opening 7 such that the winding stem 4 is held in the recess 16 to be axially movable with its section 4'".

In the embodiment shown the insert or the part 3" on its entire circumference 13 is held in the recess 7 so that only the arched end face 14 projects over the end of the part 3' facing away from the tube 2.

Figure 6:
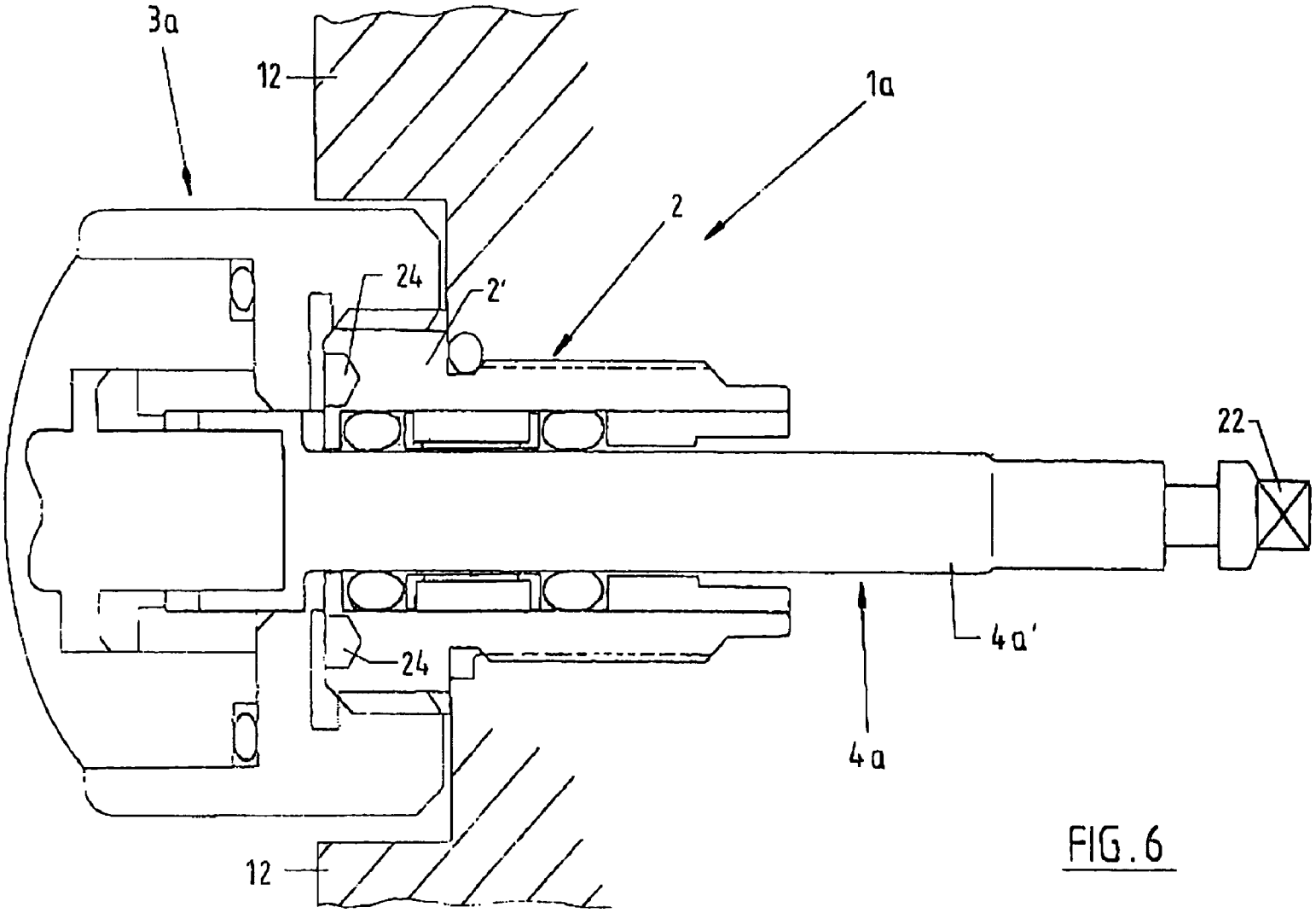
FIG. 6 is a representation similar to FIG. 1 shows another possible embodiment of the invention.

FIG. 6 shows in a representation similar to FIG. 1 as another embodiment a crown 1*a* in which on the free end of the section 4*a'* of the winding stem 4*a,* which section corresponds to the section 4', there is additionally a square 22 which interacts with the corresponding coupling piece of the movement. The winding stem 4*a* is already prepared with this square. This version is especially well suited in a crown in which the penetration or the tube 2 for the winding stem 4*a* is provided by screwing in the watch case and thus there is accurate positioning of the winding stem 4*a* with the crown screwed and the crown not screwed, especially also by the possibility of axial adjustment of the tube 2 on the watch case. The execution of FIG. 6 has the additional advantage that lengthwise matching of the winding stem 4*a* is no longer necessary, in contrast to the existing prior art.

Figure 8:
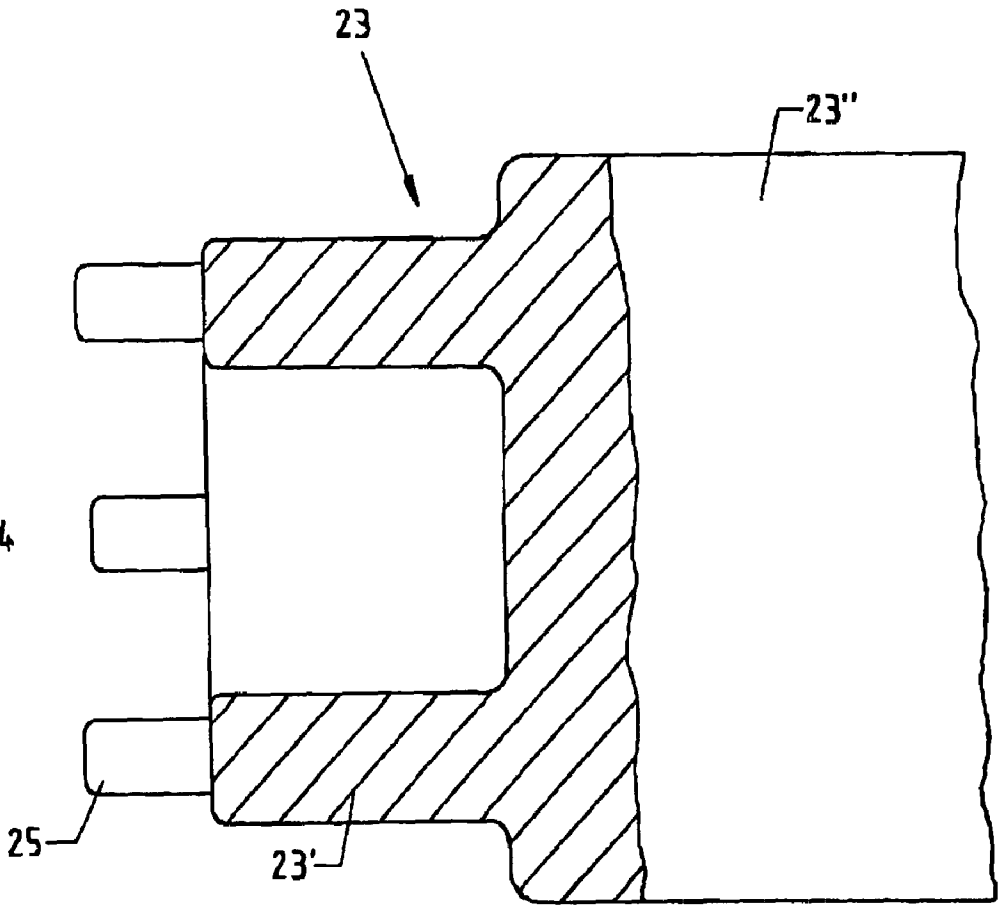
FIG. 8 shows in a partial representation a screw-in tool.
Figure 7:
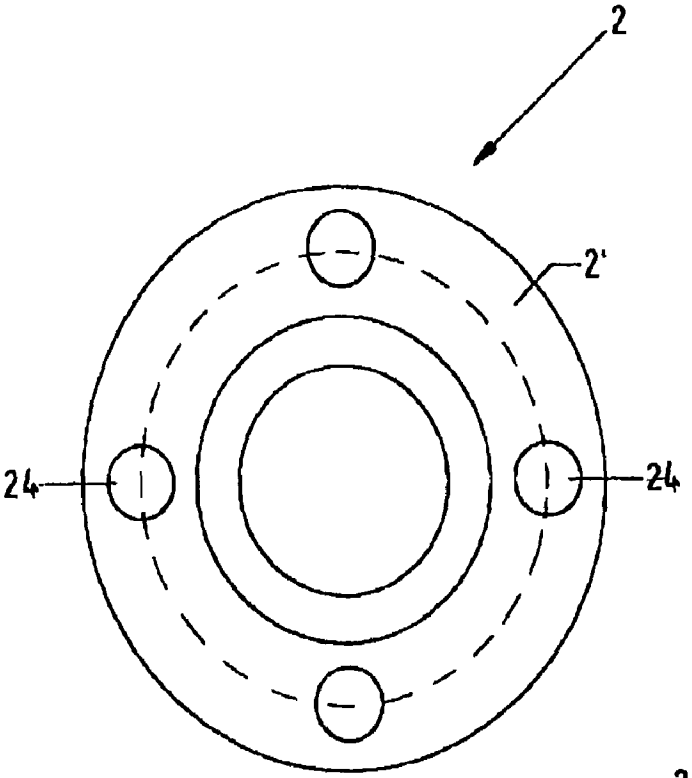
FIG. 7 in a front view shows the screw-in tube.

FIGS. 7 and 8 show in a front view the tube 2 which is used for penetration of the winding stem and a tool 23 for mounting the tube. The latter in the area of its end which projects out of the watch case has an annular collar 2' on which there are four holes 24 which are offset around the lengthwise axis L. With the tool 23 shown in FIG. 8 the tube 2 provided with an outside thread can be screwed in the corresponding hole of the watch case which is provided with an inside thread. The tool 23 for this purpose has an end 23' which is made sleeve-shaped and which is made coaxial with the other, essentially cylinder-shaped tool section 23" which is used as a handle and on its face end has four pin-like projections 25 which are offset at uniform angular distances around the tool axis and which lie with their axis parallel to the lengthwise axis of the tool 23, and of which each fits into a hole 24 for screwing or releasing the tube 2.

The invention was described above in embodiments. It goes without saying that numerous changes and modifications are possible without in doing so departing from the inventive idea underlying the invention.

REFERENCE NUMBER LIST

1,1*a* a crown

2 winding stem penetration or tube

2' collar
3 crown body
3',3" part of two-part crown body
4,4*a* a winding stem
4',4",4'",4*a'* winding stem section
4"" clearance cut
5 compression spring
6 peripheral surface with knurling
7,8 recess
9 inner thread
10 opening with hexagon
11 undercut
12 sealing ring
13 peripheral surface
14,15 end face
16 recess
16' bearing for compression spring
17 sealing ring
18 recess
19,20 bevel
21 recess
22 square
23 tool
23',23" tool section
24 hole
25 projection
26 watch case

What is claimed is:

1. A crown for watches, comprising a winding stem, a crown body which is provided on the winding stem, said crown body comprising a first and a second crown body part, said first crown body part forms a gripping surface of the crown body, said second crown body part being anchored in a recess of the first crown body part, a crown body thread by which the crown body can be threaded to a tube, which is provided on a watch case for the winding stem, a first coupling section formed on the crown body by an opening having an inside cross section which differs from a circular shape, a second coupling section on the winding stem with an outside cross section which is matched to the inside cross section of the first coupling section, the crown body being axially guided on a guide section of the winding stem, the first and second coupling sections disengaging by axial displacement of the crown body on said guide section, said first crown body part having said crown body thread, said first crown body part having said first coupling section, said second crown body part being inserted into said recess of the first crown body part from a side facing away from the tube.

2. The crown as claimed in claim 1, wherein the guide section of the winding stem has a diameter which is greater than the diameter of the second coupling section.

3. The crown as claimed in claim 1, wherein the first coupling section and the second coupling section are each formed by a hexagon.

4. The crown as claimed in claim 1, wherein the first part of the crown body has two recesses at a time which are open to one end face of this part, wherein the first of these recesses is designed to hold the second part of the crown body and the second of these recesses is provided with an inside thread for screwing the crown body on the outside thread of the tube.

5. The crown as claimed in claim 4, wherein between the first and second recess in the first part of the crown body there is an opening which is coaxial with these recesses and through which the winding stem extends and which forms the first coupling section.

6. The crown as claimed in claim 1, wherein on a free end of the winding stem there is a square which interacts with the movement.

7. The crown as claimed in claim 1, wherein on the first coupling section and/or on the second coupling section there is one bevel each, in a form of a conical surface which surrounds a lengthwise axis of the crown.

8. The crown as claimed in claim 1, further comprising a compression spring which acts between the winding stem and the crown body.

9. The crown as claimed in claim 8, wherein the compression spring acts between a contact surface on the winding stem and a contact surface on the second part of the crown body.

10. The crown as claimed in claim 1, wherein the second part is an insert and projects only with one end face out of the first part of the crown.

11. A crown arrangement, comprising a crown as claimed in claim 1 and a screw-in penetration for the winding stem.

12. A crown for watches, comprising a winding stem, a crown body which is provided on the winding stem, said crown body comprising a first and a second crown body part, said first crown body part forms a gripping surface of the crown body, said second crown body part being anchored in a recess of the first crown body part, a crown body thread by which the crown body can be threaded to a tube, which is provided on a watch case for the winding stem, a first coupling section formed on the crown body by an opening having an inside cross section which differs from a circular shape, a second coupling section on the winding stem with an outside cross section which is matched to the inside cross section of the first coupling section, the crown body being axially guided on a guide section of the winding stem, the first and second coupling sections disengaging by axial displacement of the crown body on said guide section, said first crown body part having said crown body thread, said first crown body part having the first coupling section, said second crown body part being inserted into said recess of the first crown body part from a side facing away from the tube, a bevel on the first coupling section and/or on the second coupling section, each in a form of a conical surface which surrounds a lengthwise axis of the crown.

* * * * *